US007243905B2

(12) United States Patent
Henderson

(10) Patent No.: US 7,243,905 B2
(45) Date of Patent: Jul. 17, 2007

(54) HEAVY OBJECT LIFTING APPARATUS AND METHOD

(75) Inventor: Mark Henderson, Albuquerque, NM (US)

(73) Assignee: Jack B. Henderson Construction, Albuquerque, NM (US)

( * ) Notice: Subject to any disclaimer, the term of this patent is extended or adjusted under 35 U.S.C. 154(b) by 293 days.

(21) Appl. No.: 10/172,031

(22) Filed: Jun. 13, 2002

(65) Prior Publication Data

US 2003/0062513 A1 Apr. 3, 2003

Related U.S. Application Data

(60) Provisional application No. 60/326,829, filed on Oct. 2, 2001.

(51) Int. Cl.
*B66F 11/00* (2006.01)

(52) U.S. Cl. ..... 254/8 R

(58) Field of Classification Search ..... 254/8 B, 254/8 R, 131, 134, 133; 414/684.3; 280/47.24, 280/646, 47.27, 47.26, 767, 43.15, 43.16
See application file for complete search history.

(56) References Cited

U.S. PATENT DOCUMENTS

| | | | | |
|---|---|---|---|---|
| 2,600,577 | A | 6/1952 | Roe | |
| 2,638,730 | A * | 5/1953 | Davidson | 280/47.131 |
| 4,323,329 | A * | 4/1982 | Chlad | 414/737 |
| 4,365,925 | A | 12/1982 | Girtz | |
| 4,488,706 | A | 12/1984 | Kono | |
| 4,648,617 | A * | 3/1987 | Hannappel | 280/304.3 |
| 4,662,607 | A * | 5/1987 | Mochizuki et al. | 254/131 |
| 4,826,388 | A * | 5/1989 | Golding | 414/684.3 |
| 4,978,103 | A | 12/1990 | Moisan | |
| 5,382,131 | A * | 1/1995 | Werthmann | 414/684.3 |
| 6,202,985 | B1 | 3/2001 | Chong et al. | |
| 6,767,177 | B2 * | 7/2004 | Opitz | 414/737 |

* cited by examiner

*Primary Examiner*—Robert C. Watson
(74) *Attorney, Agent, or Firm*—Deborah A. Peacock; Vidal A. Oaxaca; Peacock Myers, P.C.

(57) ABSTRACT

A lifter with an adjustable wheel base comprising a lever assembly, an adjustable axle assembly, and a lifting assembly. The lifting assembly may be magnetic and may additionally comprise safety cables having other attachment means.

19 Claims, 3 Drawing Sheets

HEAVY OBJECT LIFTING APPARATUS AND METHOD

CROSS-REFERENCE TO RELATED APPLICATIONS

This application claims the benefit of the filing of U.S. Provisional Patent Application Ser. No. 60/326,829, entitled "Trench Cover Remover", filed on Oct. 2, 2001, and the specification thereof is incorporated herein by reference.

BACKGROUND OF THE INVENTION

1. Field of the Invention (Technical Field)

The present invention relates to the lifting, moving, maneuvering, and positioning of large heavy objects, particularly trench covers or utility access plates.

2. Background Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

Large, unwieldy objects often require lifting and positioning, such as utility access plates and trench covers. Prior art devices, specifically for use with trench covers, have offered some assistance, but fall short in design, requiring trench covers with specially designed orifices for insertion of the device. (See U.S. Pat. No. 4,488,706 to Kono, U.S. Pat. No. 4,662,607 to Monchizuki et al., U.S. Pat. No. 6,202,985 to Chong et al., and U.S. Pat. No. 4,978,103 to Moisan.) Other devices require that a hook receipt area be formed on the trench cover or other object to be moved. (See U.S. Pat. No. 5,382,131 to Werthmann and U.S. Pat. No. 4,365,925 to Girtz.) With the different device, trench cover, and other utility access panel manufacturers, it would prove difficult to find one device which would easily access all panels and covers. Further, these access cover-specific devices could not be used on other heavy metal objects since they would not necessarily have an insertion point for receipt of hooks or shape specific "keys." Therefore, there is a great need for an apparatus which can be easily used on all access covers as well as other heavy metal objects.

Another problem with the prior art devices heretofore mentioned is that they all have fixed axle lengths. For larger access panels with sizable width and lengths, the prior art devices could not straddle the resultant large opening. This would render the devices useless or at least a safety hazard since they would or might fall in the resultant hole. This is an unacceptable risk to a user. For these and other reasons, there is a great need in the art for an apparatus for lifting heavy objects which has an adjustable axle width for accommodating larger openings.

SUMMARY OF THE INVENTION (DISCLOSURE OF THE INVENTION)

The present invention is an apparatus for lifting and maneuvering trench covers or other heavy metallic objects. The apparatus of the present invention comprises a lever assembly, at least one axle assembly, and a lifting assembly. The apparatus provides an adjustable axle width for accommodation of multiple cover sizes and lifting assemblies capable of use on a variety of access cover types as well as other heavy metal objects.

The preferred embodiment of the present invention is an object lifter comprising a lever assembly, at least one adjustable axle assembly, and a lifting assembly. The lever assembly comprises a lever and a handle. The handle may be selected from the group consisting of a D-shaped handle, a T-shaped handle, a rectangular frame handle, an ergonomic handle, and a lever end.

The adjustable axle assembly of the preferred lifter embodiment comprises an axle crossbar, at least one depending strut, at least one wheel axle, and at least one wheel. Embodiments may comprise two depending struts, two wheel axles, and two wheels. Alternate embodiments may comprise two depending struts, two wheel axles, and four wheels. Further embodiments may comprise one depending strut, one wheel axle, and one wheel. Additional embodiments may comprise one depending strut, one wheel axle and two wheels.

The depending strut of the axle assembly comprises a vertical strut and a horizontal tubular attachment bar, wherein the horizontal tubular attachment bar comprises an internal radius greater than an external radius of the axle crossbar. The horizontal tubular attachment bar may simply comprise a tubular opening in the vertical strut. The horizontal tubular attachment bar and the axle crossbar comprise corresponding locking pin receipt holes.

The lifting assembly of the preferred lifter may comprise a cable disposed between either one of a lever on the lever assembly or an axle crossbar on the axle assembly and at least one attachment assembly. In the preferred embodiment, the attachment assembly comprises a magnet. In alternate embodiments, the attachment assembly may comprise at least one trench cover locking pin attachment assembly having a locking pin disposed on an end of a cable, wherein the cable is disposed between the locking pin and a lever or axle crossbar. Further, the attachment assembly may comprise at least one hook attachment assembly having a hook disposed on an end of a cable, wherein the cable is disposed between the hook and a lever or axle crossbar.

Another embodiment of the lifter comprises a lever assembly, an axle assembly, and at least one lifting assembly, wherein the at least one lifting assembly comprises an attachment assembly having a magnet.

The present additionally comprises a method of adjusting a wheel base length of a lifter comprising the steps of providing a lifter comprising at least one adjustable axle assembly; disengaging any locking mechanisms fixing said adjustable axle assembly; sliding an attachment bar of said adjustable axle assembly laterally along an axle crossbar of said adjustable axle assembly to lengthen or shorten the wheel base length of said axle assembly; engaging any locking mechanisms to fix said axle assembly; and repeating all steps for any additional axles.

The present invention also comprises a method of use of a lifter to lift an object comprising providing a lifter comprising a lever assembly, at least one adjustable axle assembly, and at least one lifting assembly; adjusting all axle widths of said adjustable axle assembly to form a sufficient wheel base length to allow the lifter to straddle the object to be lifted and any resultant opening; allowing any magnetic attachment assemblies of said lifting assembly to magnetically engage the object; attaching any non-magnetic attachment assemblies of said lifting assembly; applying downward force on a handle or handle end of a lever; pivoting the lever about its fulcrum, thereby lifting the object; maneuvering the object into a desired position; removing the downward force on the handle thereby allowing the object to descend to the ground; releasing the magnetic assembly; and disengaging any safety cables.

A primary object of the present invention is to provide an apparatus for lifting trench covers, access hole covers, and other heavy metal objects.

A primary advantage of the present invention is that the invention is interchangeable between covers and objects from different manufacturers.

Another advantage of the present invention is that it does not require pre-formed attachment areas on the object.

Yet another advantage of the present invention is that it incorporates an adjustable axle to accommodate various opening sizes.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DESCRIPTION OF THE PREFERRED EMBODIMENTS BEST MODES FOR CARRYING OUT THE INVENTION

The present invention is an apparatus for lifting and maneuvering trench covers or other heavy metallic objects. The apparatus of the present invention comprises a lever assembly, at least one axle assembly, and a lifting assembly. The apparatus provides an adjustable axle width for accommodation of multiple cover sizes and lifting assemblies capable of use on a variety of access cover types as well as other heavy metal objects.

Figure 1:
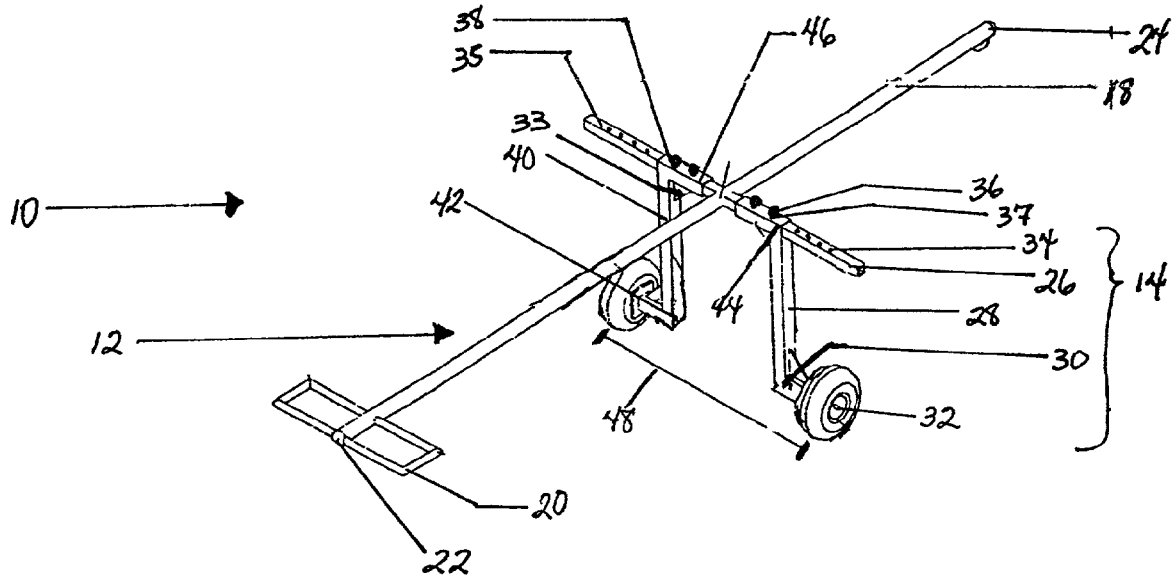
FIG. 1 is a perspective drawing of the present invention depicting the lever and axle assembles.
Figure 2:
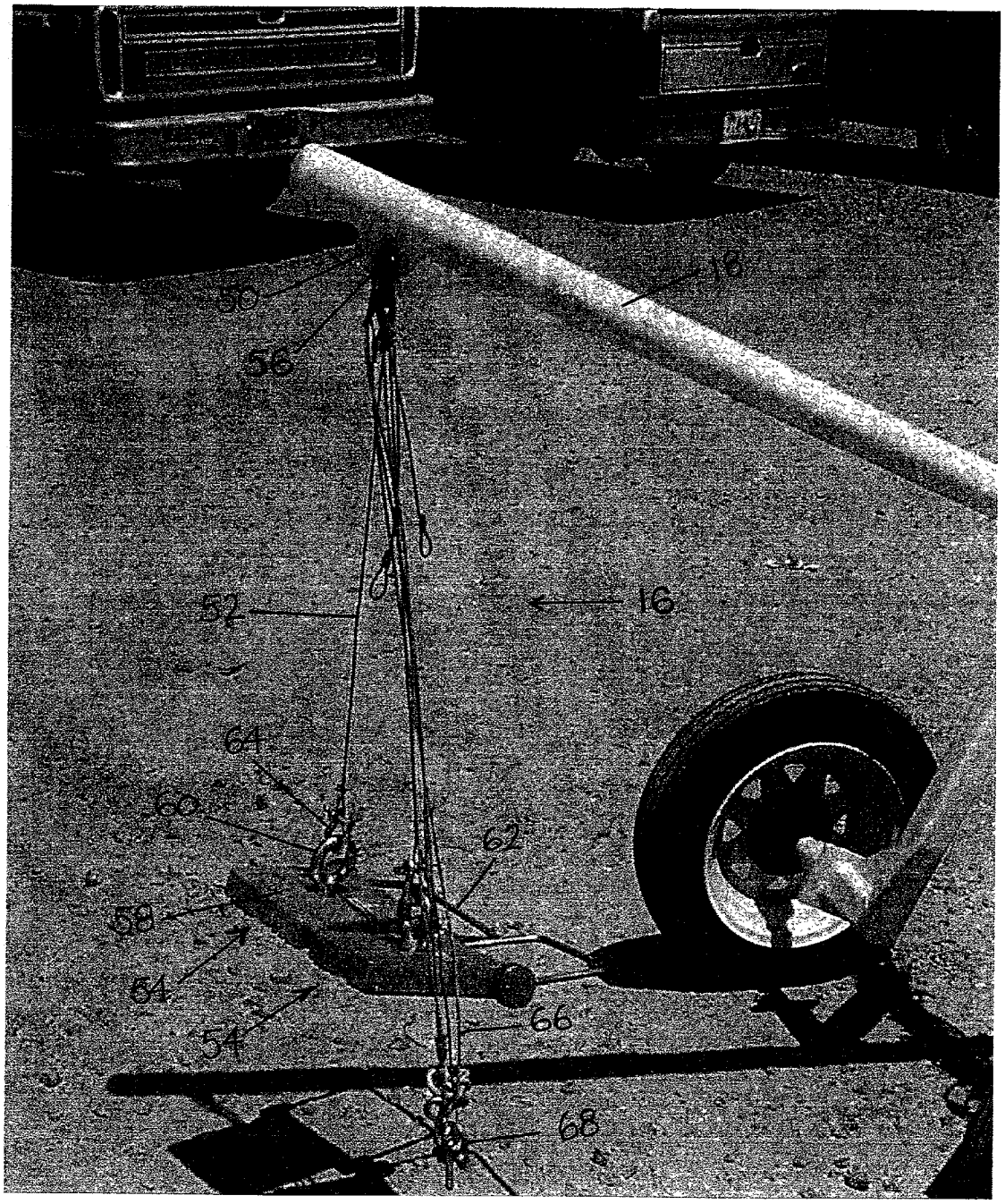
FIG. 2 is a partial perspective view of the present invention depicting the lifting assembly.
Figure 3:
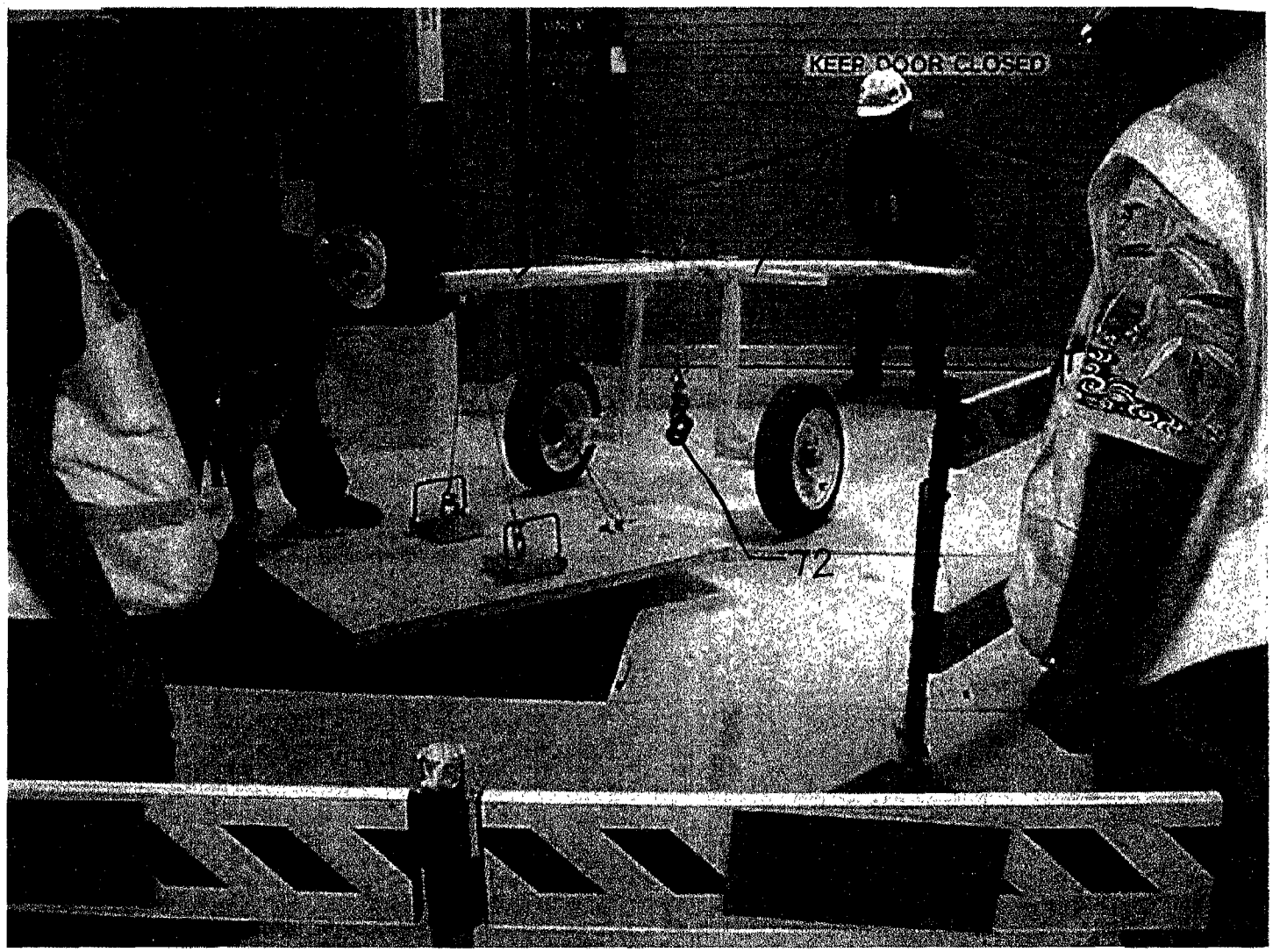
FIG. 3 is a perspective view of the present invention in use.

Turning now to the drawings, FIGS. 1 to 3 illustrate the preferred embodiment of the invention.

FIG. 1 is a perspective view of lifting apparatus 10 of the present invention, specifically depicting lever assembly 12 and axle assembly 14.

Lever assembly 12 comprises lever 18 and handle 20.

Lever 18 is preferably a length of pipe (solid or hollow) comprising metal or metal composites, particularly steel, but alternate embodiments may comprise plastic resins, wood of a suitable strength, or other suitable materials known in the art. Lever 18 is preferably approximately 10 feet in length and approximately 2" in diameter, but may be larger or smaller depending on the object to be lifted and the necessary leverage and strength required. Lever 18 may have any external configuration, including but not limited to round, rectangular, ellipsoidal, triangular, or polygonal.

Handle 20, as depicted in FIG. 1, is disposed on handle end 22 of lever 18. In the preferred embodiment, handle 20 is a rectangular frame intersected by lever 18. Other handle types, including but not limited to D-shaped, ergonomic, or T-bar, may be utilized. Handle 20 preferably comprises materials similar to those used in lever 18. In an alternate embodiment, no handle is utilized and a user simply lifts and maneuvers with handle end 22 of lever 18. Additionally, in alternate embodiments handle 19 may comprise ergonomic or "comfort" coverings, coatings, or attachments (e.g., a rubber covering having grips).

Lifting assembly 16 is not depicted in FIG. 1, but is disposed on lifting end 24 of lever 18, and is discussed in greater detail infra.

Axle assembly 14 comprises axle cross bar 26, at least one depending strut 28, at least one wheel axle 30, and wheels 32. The preferred embodiment comprises two depending struts, wheel axles and wheels. However, alternate embodiments may comprise configurations including, but not limited to, having one depending strut, wheel axle and wheel, or two depending struts, each having a wheel axle and two wheels. Additionally, more than one axle assembly (i.e., multiple axle crossbars, etc.) may be utilized.

Axle cross bar 26 is either integral with or disposed on lever 18, preferably positioned in a perpendicular relation at a point disposed between ends 22, 24 of lever 18, most preferably at a point slightly closer to lifting end 24. Axle cross bar 26 may be affixed to lever 18 in any conventional manner, including but not limited to welding, bolting, and slidable engagement (preferably with removable securing devices, including but not limited to, bolts and nuts) through interchangeable fixed openings disposed throughout lever 18.

Axle cross bar 26 comprises multiple pin receipt openings 34 disposed along its upper surface 35 for receipt of locking pin 36 first engaged through pin receipt openings 37 disposed along upper surface 38 of depending strut 28, as discussed infra.

Depending strut 28 comprises vertical strut 40 and tubular axle attachment bar 46. Vertical strut 40 is disposed between lower wheel axle attachment end 42 and upper axle cross bar attachment end 44. Vertical strut 40 is preferably a length of pipe (solid or hollow) comprising metal or metal composites, particularly steel, but alternate embodiments may comprise plastic resins, wood, or other materials of a suitable strength. Vertical strut 40 preferably comprises a rectangular tubing configuration, but other shapes may be utilized, including but not limited to round, ellipsoidal, triangular, and polygonal.

Tubular axle attachment bar 46 is disposed in perpendicular relation to strut 40 on its upper axle cross bar attachment end 44. Bar 46 has opposing open ends for receipt of axle cross bar 26, which has a smaller radius than bar 46 and is slidably disposed therein. Bar 46 may, but does not necessarily, extend beyond the width of strut 40 (i.e., bar 46 may comprise an upper tubular opening on strut 40). Attachment bar 46 and cross bar 26 are adjustably connected by engagement of locking pin 36 through locking pin receipt openings 37 (disposed at intervals throughout the upper surface of attachment bar 46) and corresponding locking pin receipt holes 34 (disposed at corresponding intervals along the upper surface of cross bar 26). The overall length of wheel base 48 is adjustable by removing locking pin 36, pulling attachment bar 46 laterally in either direction to lessen or lengthen wheel base 48, and engaging locking pin 36 in a different set of corresponding holes 34, 37. Openings 34, 37 may be alternately disposed on either or both sides or the lower surfaces of bars 46, 26. They may alternately be disposed completely through bars 46, 26, and may be engaged by other suitable locking mechanisms, including but not limited to bolt-and-nut, and bolt-and-wing nut.

Wheel axle 30 comprises a horizontal length extending from lower wheel axle attachment end 42 of strut 40 to wheel 32. Wheel axle 30 may be affixed or integral to vertical strut 40. Additionally, wheel axle 30 may be affixed to wheel 32 in any conventional manner.

Axle assembly 14 may additionally comprise braces 33 or other frame strengthening elements. Further, multiple axle assemblies may be used.

Lifting assembly 16, shown in a partial perspective view of the present invention in FIG. 2, comprises cable 52, and magnetic attachment assembly 54. As shown in FIG. 2, lever attachment point 50 comprises an affixed or integral attachment opening 56 (e.g., lever attachment point 50 as a ring or hook) for receipt of cable 52. Magnetic assembly 54 comprises industrial grade magnet 58, having a sufficient magnetic attraction to safely lift large metallic objects, preferably approximately 375 lbs. However, magnets with a greater or lesser magnetic strength may be utilized, depending on the object to be lifted. Assembly 54 is affixed to cable 52 at magnet attachment point 60. Preferably, assembly 16 additionally comprises magnet release 62. Magnet attachment point 60 is preferably disposed on an upper surface of magnet 58 and preferably comprises a ring or other opening configured for receipt of cable 52. Assembly 16 may comprise multiple attachment points and cables. In the preferred embodiment, lifting assembly 16 comprises two magnetic assemblies 54, each attached by individual cables 52 to lever 18. In alternate embodiments, one magnetic assembly or more than two magnetic assemblies may be utilized. Additionally, more than one cable may be attached to any assembly. In a preferred embodiment, cables 52 are attached to either or both of magnet attachment point 60 and lever attachment point 50 by devises 64.

Any cable designated within the invention may be comprised of materials including but not limited to steel or other metal based cables, chains, ropes, and fixed or jointed bars. Cables may additionally comprise multiple attachment points along their lengths wherein the overall cable length may be adjusted.

In the preferred embodiment, lifting assembly 16 additionally comprises trench cover pin safety cables 66 (attached to lever 18 at attachment opening 56) and trench cover pins 68 (disposed on the opposing end of cables 66 from attachment opening 56). Trench cover pins 68 are preferably configured for insertion into most known trench cover pin openings. Additionally, as shown in FIG. 3, in the preferred embodiment, hook safety cables 70 are disposed on cross bar 26 and have hooks 72 disposed on the opposing ends of cable 66 from cross bar 26. Safety cables 70 are preferably used by placing at least one hook 72 on an opposite side of a trench cover from at least one other hook 72.

In alternate embodiments, safety cables 66, 70 may be utilized separately or not at all. Further, cables 66 may be disposed for attachment on cross bar 26, and cables 70 may be disposed for attachment on lever 18. Preferably an attachment point comprising a ring, rings, or other suitable means for attachment will be disposed on the crossbar or lever for receipt of such cables. Alternately, magnetic assemblies may be disposed on the axle crossbar instead of the lever. In other embodiments, alternate safety attachment devices may be utilized comprising suitable attachments to lift heavy objects. While in the preferred embodiment a magnetic attachment assembly and an adjustable axle are both utilized, alternate embodiments may only utilize one or the other. In embodiments not utilizing the magnetic attachment assembly, at least one other attachment assembly is utilized. Multiple assemblies may be utilized. In embodiments having only the magnetic assembly and not the adjustable axle, other attachment assemblies may or may not be utilized in conjunction with the magnetic assembly.

In alternate embodiments, one or more positioning legs may be disposed on the lever between the axle assembly and the lifting assembly, extending from the lever to the ground to provide a minimum resting height. Such a leg may be fixed, disengageable, or rotatably positionable.

The wheel base of the lifter of the present invention is preferably adjusted for use by removal of the locking pin (or other attachment device) engaging the axle crossbar and attachment bar, pulling the attachment bar laterally in either direction to lessen or lengthen the wheel base, and then engaging the locking pin through the locking pin holes of the attachment bar and the corresponding locking holes of the crossbar.

The lifter of the present invention is used by providing the lifter over a trench cover (or other object to be moved) such that the wheels of the lifter straddle the cover. The magnetic assembly is placed on the upper surface of the trench cover and allowed to magnetically engage. Any safety cables are attached to the cover. The lever is pushed down at its handle attachment end, thereby pivoting the lever about its fulcrum, raising the object. The lifter is pushed or pulled forward on its wheels to maneuver the cover into a desired position. The cover is then lowered by reducing downward pressure on the lifting end, resulting in the handle end pivoting upward and the lifting end pivoting downward, thereby lowering the cover to the ground. All cable attachments and the magnetic assembly are then disengaged from the cover.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An object lifter comprising:

a lever comprising two ends;

at least one adjustable axle assembly disposed along a length of said lever between said two ends and comprising:

more than three wheelbase width adjustment positions;

at least two vertical depending struts linked to said lever; and a lifting assembly disposed at one of said two ends of said lever for lifting an object located below said lifting assembly, said lifting assembly comprising an attachment assembly for connecting said lifting assembly to the object to be lifted, said lifting assembly further comprising at least one cable disposed on said lever or a crossbar of said axle assembly, said cable disposed between said lever or axle assembly crossbar and said attachment assembly, said attachment assembly comprising a magnet.

2. The lifter of claim 1 further comprising a handle disposed on said lever.

3. The lifter of claim 2 wherein said handle comprises a member selected from the group consisting of a D-shaped handle, a T-shaped handle, a rectangular frame handle, an ergonomic handle, and a lever end.

4. The lifter of claim 1 wherein said crossbar of said axle assembly is linked to at least one of said depending struts, and at least one wheel axle and at least one wheel disposed on each said vertical depending strut.

5. The lifter of claim 1 wherein each said depending strut is connected to a horizontal tubular attachment bar, said horizontal tubular attachment bar comprising an internal transverse cross-section greater than an external radius of said axle assembly crossbar.

6. The lifter of claim 5 wherein said horizontal tubular attachment bar and said axle assembly crossbar comprise corresponding locking pin receipt holes.

7. An object lifter comprising:

a lever comprising two ends;

at least one adjustable axle assembly disposed along a length of said lever between said two ends and comprising:

more than three wheelbase width adjustment positions;

at least two vertical depending struts linked to said lever; and a lifting assembly disposed at one of said two ends of said lever for lifting an object located below said lifting assembly, said lifting assembly comprising an attachment assembly for connecting said lifting assembly to the object to be lifted, said lifting assembly further comprising at least one cable disposed on said lever or a cross bar of said axle assembly, said cable disposed between said lever or axle assembly crossbar and said attachment assembly, said attachment aesembly comprising at least one trench cover locking pin attachment assembly having a locking pin disposed on an end of a cable, wherein said cable is disposed between said locking pin and a lever or axle assembly crossbar in said lever.

8. The lifter of claim 7 further comprising a handle disposed on said lever.

9. The lifter of claim 8 wherein said handle comprises a member selected from the group consisting of a D-shaped handle, a T-shaped handle, a rectangular frame handle, an ergonomic handle, and a lever end.

10. The lifter of claim 7 wherein said crossbar of said axle assembly is linked to at least one of said depending struts, and at least one wheel axle and at least one wheel disposed on each said vertical depending strut.

11. The lifter of claim 10 wherein each said depending strut is connected to a horizornal tubular attachment bar, wherein said horizontal tubular attachment bar comprises an internal transverse cross-section greater than an external radius of said axle crossbar.

12. The lifter of claim 11 wherein said horizontal tubular attachment bar and said axle assembly crossbar comprise corresponding locking pin receipt holes.

13. An object lifter comprising:

a lever comprising two ends:

an axle assembly comprising:

an axle cross bar, said axle cross bar disposed along a length of said lever between said two ends:

an axle attachment bar in which said axle bar is removably disposed to provide for disassembly and ease in portability and storing of said lifter;

said lever comprising a length greater than a width of said axle assembly; and at least one lifting assembly, disposed at one of said two ends of said lever for lifting an object located below said lifting assembly, said lifting assembly comprising a magnet and an attachment assembly for connecting said lifting assembly to the object to be lifted.

14. The lifter of claim 13 further comprising a handle disposed on said lever.

15. The lifter of claim 14 wherein said handle comprises a member selected from the group consisting of a D-shaped handle, a T-shaped handle, a rectangular frame handle, an ergonomic handle, and a lever end.

16. The lifter of claim 13 wherein said axle assembly is adjustable in more than two wheel base width positions and comprises an axle crossbar, at least one depending strut, at least one wheel axle, and at least one wheel.

17. The lifter of claim 16 wherein said depending strut comprises a vertical strut and a horizontal tubular attachment bar, wherein said attachment bar comprises an internal transverse cross-section greater than an external transverse cross-section of said axle crossbar.

18. The lifter of claim 13 wherein said attachment bar and said axle crossbar comprise corresponding locking pin receipt holes.

19. The lifter of claim 13 wherein said lifting assembly comprises at least one cable disposed on a lever or axle crossbar of said lever assembly, said cable disposed between said lever or said axle crossbar and said attachment assembly.

* * * * *